US005454692A

United States Patent [19]

Davis

[11] Patent Number: 5,454,692

[45] Date of Patent: Oct. 3, 1995

[54] CEILING FAN HAVING AN INTEGRAL GLASS HOUSING

[75] Inventor: William S. Davis, Jr., Fort Worth, Tex.

[73] Assignee: Davoil, Inc., Fort Worth, Tex.

[21] Appl. No.: 292,357

[22] Filed: Aug. 18, 1994

[51] Int. Cl.[6] ..... F04D 19/00

[52] U.S. Cl. ..... 416/5; 416/170 R; 362/363

[58] Field of Search ..... 416/5, 170 C; 362/96, 363

[56] References Cited

U.S. PATENT DOCUMENTS

| | | | |
|---|---|---|---|
| 324,565 | 3/1992 | Fraser | D23/411 |
| 2,975,271 | 3/1961 | Dvorak | 362/363 |
| 4,313,153 | 1/1982 | Davis | 362/184 |
| 4,342,073 | 7/1982 | Ranten | 362/294 |
| 4,382,400 | 5/1983 | Stutzman | 416/5 |
| 4,402,649 | 9/1983 | Laurel | 416/5 |
| 4,808,071 | 2/1989 | Chau | 416/170 C |
| 5,151,011 | 9/1992 | Rezek | 416/5 |
| 5,222,864 | 6/1993 | Pearce | 416/170 R |
| 5,302,083 | 4/1994 | Bucher et al. | 416/5 |

FOREIGN PATENT DOCUMENTS

| | | | |
|---|---|---|---|
| 0110798 | 7/1982 | Japan | 416/170 C |
| 0101292 | 6/1983 | Japan | 416/170 C |

*Primary Examiner*—F. Daniel Lopez
*Assistant Examiner*—Mark Sgantzos
*Attorney, Agent, or Firm*—James E. Bradley; Max Ciccarelli

[57] ABSTRACT

A ceiling fan has a downrod assembly with an upper end adapted to be mounted to a ceiling and a lower end adapted to be mounted to a motor. A motor is mounted to the lower end of the downrod assembly. A set of fan blades is fastened to the motor. A substantially flat metal top has a central opening through which the downrod assembly extends. The metal top is fastened to a flange on the lower end of the downrod assembly. An annular cylindrical glass sidewall has an upper circumferential edge adapted to mate a circumferential portion of the metal top. A substantially flat glass bottom is integrally joined to a lower edge of the sidewall. The glass bottom has a central opening through which the fan blades of the ceiling fan extend. Elongate fasteners extend through holes in the metal top and through holes in the glass bottom and secure the integrally joined sidewall and bottom to the metal top wherein a translucent ceiling fan housing is formed.

14 Claims, 3 Drawing Sheets

CEILING FAN HAVING AN INTEGRAL GLASS HOUSING

BACKGROUND OF THE INVENTION

1. Field of the Invention

This invention relates in general to ceiling fans, and in particular to a ceiling fan having an integral glass housing.

2. Description of the Prior Art

Ceiling fans are commonly used for both circulating the air and for enhancing the aesthetics of the room or area in which they are located. These ceiling fans usually have a housing or enclosure which surrounds the motor of the ceiling fan, giving the ceiling fan a more pleasing appearance. The housing is typically formed from an upper plate which covers the upper portion of the motor, and a lower plate which covers the lower portion of the motor. The lower plate usually has an opening thorough which the fan blades extend from the motor. A midsection, usually consisting of a cylindrical band, is located between the upper and lower plates. The upper plate, lower plate, and midsection may be provided with decorative or ornamental designs to enhance their appearance. Fasteners extending between the upper and lower plates connect the upper plate, lower plate, and midsection together by sandwiching the midsection between the upper plate and lower plate. Lights are sometimes provided for attachment to the bottom of the ceiling fan.

For many years, the upper plate, lower plate, and midsection were all constructed of metal. The metal construction effectively hid the interior of the fan from view. Also, the metal construction allowed easy fastening of the upper plate, lower plate, and midsection together.

However, it then became fashionable and desirable to have translucent housings. Translucent housings are considered decorative and functional. One of the functional aspects is that lights can be placed inside the housing to illuminate the housing and the room within which the ceiling fan is located. Several ceiling fans with translucent housings are currently available on the market. For example, some manufacturers use the conventional three-piece ceiling fan design but manufacture the upper plate, lower plate, and midsection out of translucent materials such as acrylic. The acrylic housing results in a translucent housing of conventional design in which the upper plate, lower plate, and midsection can be easily bolted together.

An example of such a translucent ceiling fan housing is shown in FIG. 1. A circular translucent upper plate 10 is shown extending over the ceiling fan motor 12. A circular translucent lower plate 14 is shown extending below motor 12. A midsection 16, consisting of a cylindrical translucent annular band, is located between the upper and lower plates 10, 14. Fasteners 18 extending between upper plate 10 and lower plate 14 hold upper plate 10, lower plate 14, and midsection 16 together. A centrally located circular opening 19 in lower plate 14 is provided through which the fan blades extend from the motor. Light means 20 is provided within the translucent housing.

Manufacturers have also made translucent housings out of glass. However, they have been unable to make glass housings using the conventional three-piece design. This is in part due to the difficulty of bolting together two pieces of glass. For example, if both the midsection 16 and lower plate 14 of the prior art fan of FIG. 1 were made out of glass, the midsection 16 and lower plate 14 would soon come unfastened. Although this problem could be avoided by placing rubber washers between midsection 16 and lower plate 14, such a solution would not be aesthetically acceptable. Hence, manufacturers have departed from the traditional three-piece design and have instead moved to a two-piece bowl-shaped design.

FIG. 2 shows such a prior art two-piece bowl-shaped design. A circular metal upper plate 22 extends over the motor 24. A bowl-shaped glass section 26 is fastened to upper plate 22 by means of fasteners 28. Fasteners 28 extend radially through holes in an upper portion of glass section 26 and holes in tabs 29 attached to upper plate 22 so as to fasten the upper portion of glass section 26 to upper plate 22. An opening 32 at the bottom of the bowl-shaped glass section 26 is provided through which the fan blades extend from the motor. The prior art fan of FIG. 2 is also provided with a light means 30, within the housing.

Of course, such a two-piece bowl-shaped design differs greatly from the traditional three-piece design both aesthetically and functionally. Aesthetically, the bowl-shaped design does not have the cylindrical midsection of the traditional design shown in FIG. 1, nor does it have the flat bottom. Functionally, the light distribution is different from the traditional design, and more vertical room is required with the bowl-shaped housing than is required with the housing of traditional design.

A need exists for a ceiling fan having a translucent housing made of glass and having the traditional design in which the top and bottom of the housing are substantially flat, and the midsection of the housing is cylindrical.

SUMMARY OF THE INVENTION

It is the general object of the invention to provide a ceiling fan having a translucent housing made of glass and having a substantially flat top, a substantially flat bottom, and a cylindrical midsection.

The ceiling fan of the present invention has a downrod assembly having an upper end adapted to be mounted to a ceiling and a lower end adapted to be mounted to a motor. A motor is mounted to the lower end of the downrod assembly. A set of fan blades is mounted to the motor. A substantially flat metal top has a central opening through which the downrod assembly extends. The metal top is fastened to a flange which comprises the lower end of the downrod assembly. An annular cylindrical glass sidewall has an upper circumferential edge adapted to mate a circumferential portion of the metal top. A substantially flat glass bottom is integrally joined to a lower edge of the sidewall. The glass bottom has a central opening through which the fan blades of the ceiling fan extend. Elongate fastening means extend through holes in the metal top and through holes in the glass bottom and secure the integrally joined sidewall and bottom to the metal top wherein a translucent ceiling fan housing is formed.

The above as well as additional objects, features, and advantages will become apparent in the following description.

DESCRIPTION OF THE PREFERRED EMBODIMENT

Figure 1:
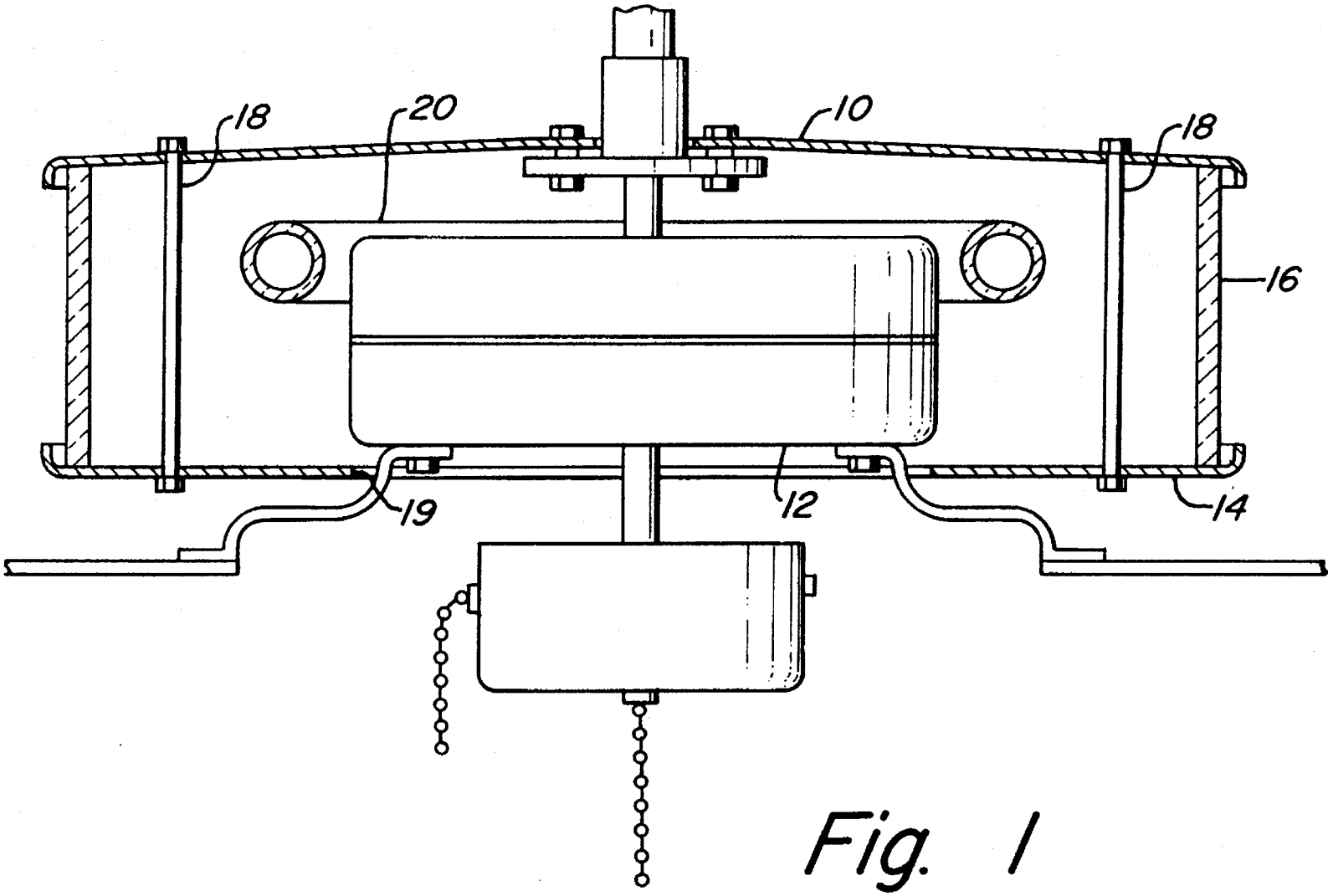
Fig. 1 (PRIOR ART)
FIG. 1 is a partial cross sectional view of a prior art ceiling fan.
Figure 2:
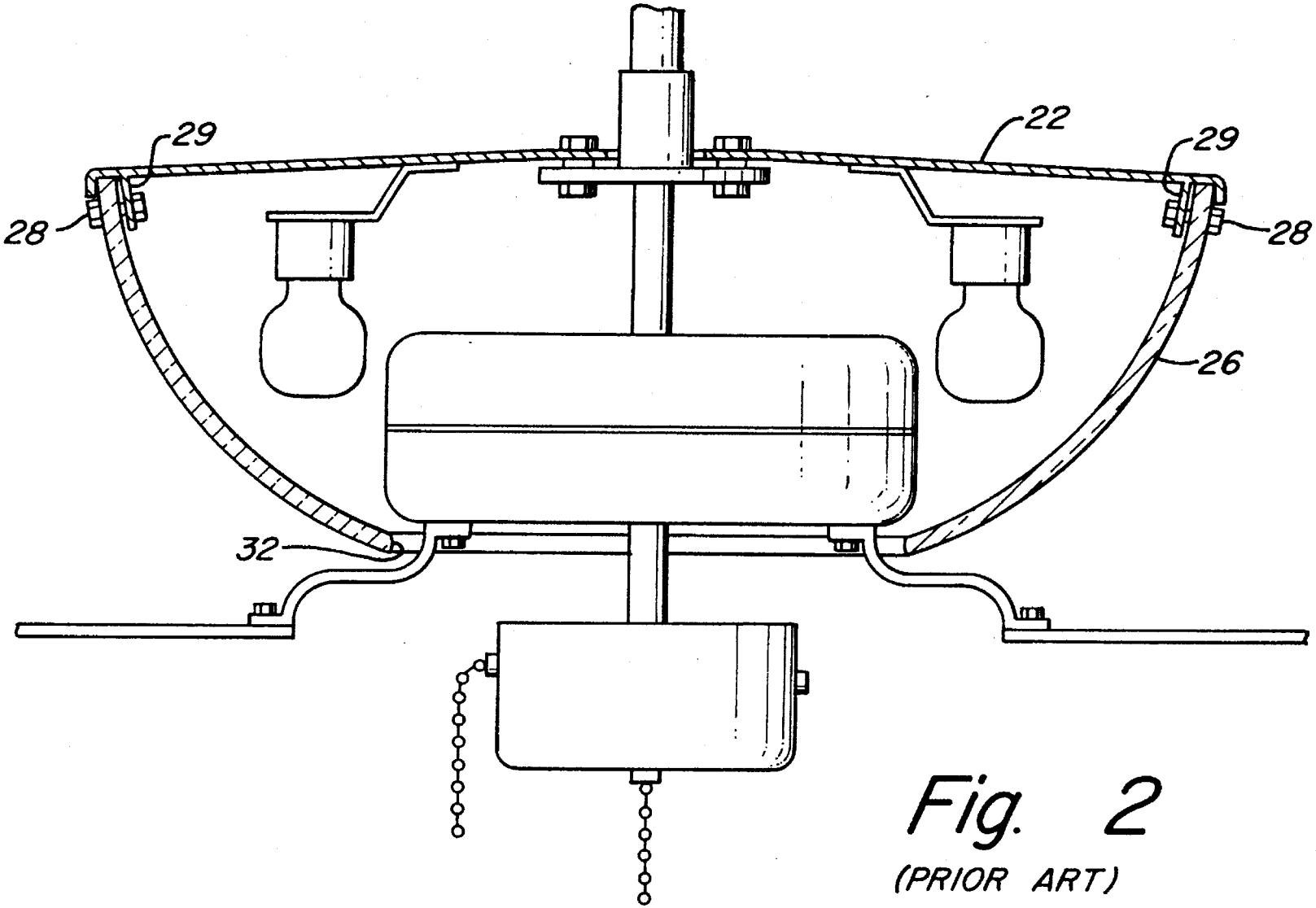
Fig. 2 (PRIOR ART)
FIG. 2 is a partial cross sectional view of another prior art ceiling fan.
Figure 3:
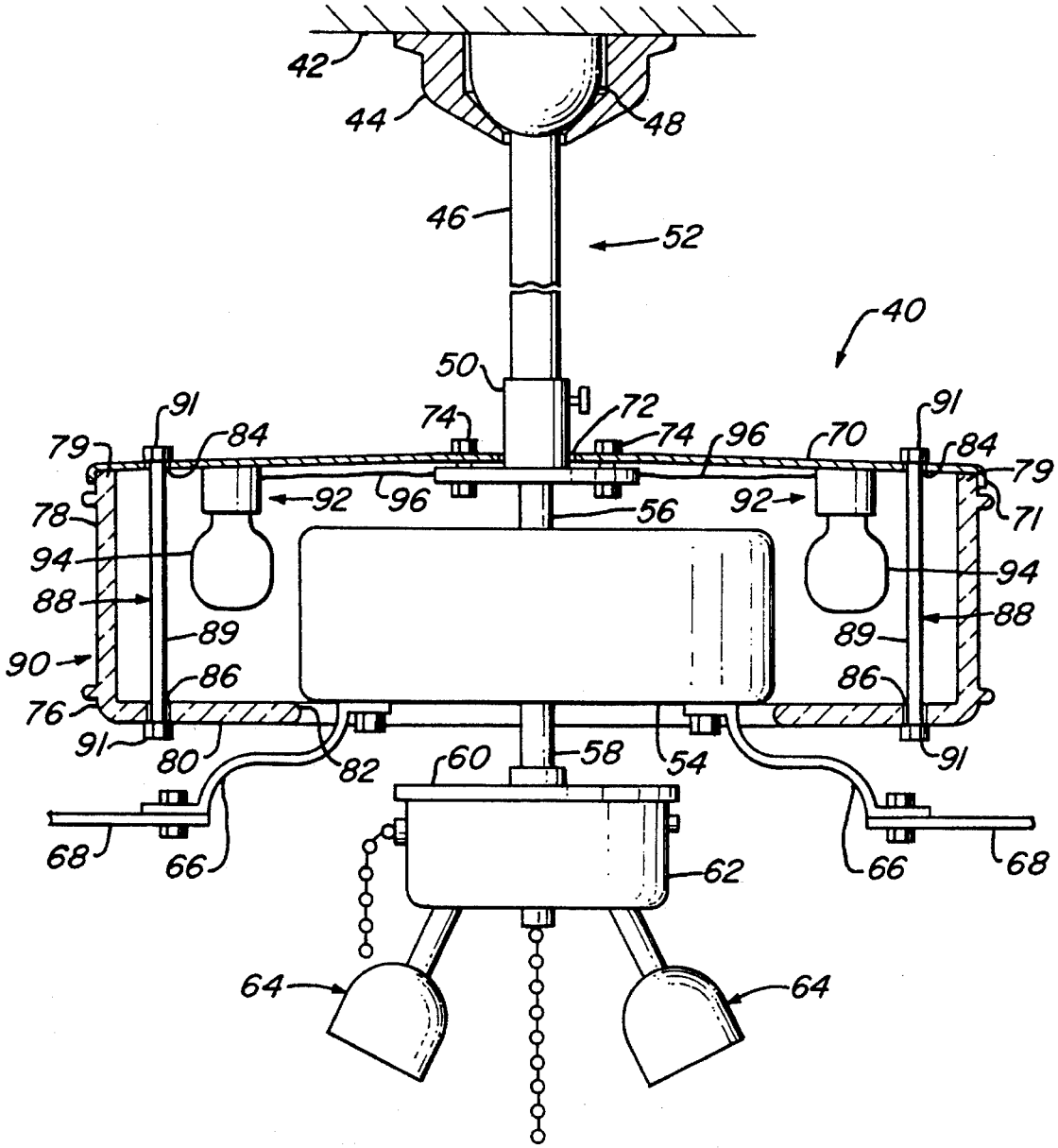
FIG. 3 is a partial cross sectional view of the ceiling fan of the present invention.

FIG. 3 shows the ceiling fan 40 of the present invention. Except for the novel housing described in more detail below, the other components of ceiling fan 40 of the present invention are generally well known in the art. Ceiling fan 40 is mounted to ceiling 42 of a room as described herein. A hanger bracket 44 is fastened to the ceiling by conventional means. A downrod 46 has a ball mount 48 attached at its upper end for engagement with hanger bracket 44. Downrod 46 extends downward from ceiling 42. At the lower end of downrod 46 is flange 50 which is fastened to downrod 46. Hanger bracket 44, downrod 46, ball mount 48, and flange 50 comprise what is generally referred to as downrod assembly 52.

Motor 54 is attached to the lower end of downrod assembly 52, and more particularly to flange 50, by conventional means such as by upper motor support member 56. Connected below motor 54 by conventional means such as lower motor support member 58 is a control cup flange 60. It is common in the industry to connect a wide variety of devices to the control cup flange 60. Often, a control cup 62 is attached thereto. It is also popular to attach a control cup 60 having a light fixture 64, as is shown in FIG. 3. Control cup 60 contains conventional controls to control the fan and the light fixture. A plurality of fan blades 68 are fastened to the bottom of motor 54 by means of arms 66.

A substantially flat, round, metal top 70 has a centrally located circular opening 72 through which flange 50 of downrod assembly 52 extends. Top 70 engages flange 50 and is fastened thereto by means of fasteners 74. Top 70 is thus connected to and suspended from flange 50 which is part of downrod assembly 52 which is in turn connected to ceiling 42. Top 70 has a lip 71 that curves downward and extends around its perimeter.

Located below metal top 70 is glass section 76 which comprises annular cylindrical glass sidewall 78 and substantially flat glass bottom 80. Sidewall 78 and bottom 80 are integrally joined so as to form unitary glass section 76 having annular cylindrical sidewalls and a substantially flat bottom. Sidewall 78 has an upper circumferential edge 79 adapted to mate and fit within lip 71 of top 70. Bottom 80 has a centrally located circular opening 82 through which extend fan blades 68 and arms 66. Bottom 80 is parallel to metal top 70.

Glass section 76 can be made of any type of glass including lead crystal glass. Glass section 76 can be formed by any number of well known methods that result in glass section 76 having a cylindrical annular sidewall 78 integrally joined with a substantially flat bottom 80. In the preferred embodiment, glass section 76, is made of lead crystal glass and is provided with patterns cut into its surface to improve the aesthetics of the fan and to alter the light distribution of the light source located within the housing.

Top 70 has vertically oriented holes 84 around its circumference. Bottom 80 has vertically oriented holes 86 that register with holes 84 in top 70. Conventional, elongate fastening means 88, such as rods 89 and heads or nuts 91, extend through top 70 and through bottom 80 and secure glass section 76 to top 70. Top 70 and glass section 76, fastened together by fastening means 88, form a translucent glass enclosure or housing 90 having a cylindrical sidewall and a flat bottom.

Located within housing 90 are light sockets 92 which receive light bulbs 94. Wiring 96 leads to control cup 62. The above light means serves to illuminate the inside of housing 90 and to project light to an exterior of housing 90.

The ceiling fan of the present invention has several advantages over the prior art ceiling fans. The ceiling fan of the present invention provides a translucent glass housing having a flat top, a flat bottom, and a cylindrical midsection. The glass housing is more appealing than other translucent housings, such as acrylic ones. Also, the glass housing allows patterns to be formed into its surface to improve the aesthetics of the fan and to alter the light distribution of the light source located within the housing. Still further, glass is not scratched as easily as acrylic and other non-glass materials.

The fan of the present invention provides a glass housing that is traditional in shape, that is, a housing having a flat top, flat bottom, and cylindrical midsection. Glass housings are becoming more popular, but are not available in the traditional design. The traditional design, having been around for many years, is still one of the favorites. The present invention combines glass construction with traditional design. The flat bottom and cylindrical sides also allow unique light distribution. Finally, the traditional shape also results in a glass housing that is more vertically compact that prior art bowl-shaped glass housings.

While the invention has been particularly shown and described with reference to a preferred embodiment, it will be understood by those skilled in the art that various changes in form and detail may be made therein without departing from the spirit and scope of the invention.

What is claimed is:

1. A ceiling fan, the ceiling fan comprising in combination:

a downrod assembly having an upper end for mounting to a ceiling and a lower end having a flange;

a motor mounted to the lower end of the downrod assembly;

a set of fan blades joined to the motor;

a substantially flat metal top having a central opening through which the downrod assembly extends, the metal top being fastened to the flange of the downrod assembly;

an annular cylindrical glass sidewall having an upper circumferential edge which mates with a circumferential portion of the metal top;

a substantially flat glass bottom integrally joined to a lower edge of the sidewall, the glass bottom having a central opening through which the fan blades of the ceiling fan extend; and elongate fastening means extending through holes in the metal top and through holes in the glass bottom for securing the integrally joined sidewall and bottom to the metal top wherein a housing is formed around the motor.

2. The ceiling fan according to claim 1 further comprising light means located within the housing for illuminating the inside of the housing and for projecting light to an exterior of the housing.

3. The ceiling fan according to claim 1 further comprising a light fixture mounted to the motor and below the housing.

4. The ceiling fan according to claim 1 further comprising:

a light means located within the housing for illuminating the inside of the housing and for projecting light to an exterior of the housing; and a light fixture mounted to the motor below the housing.

5. The ceiling fan according to claim 1 wherein the downrod assembly comprises:

a hanger bracket for mounting to the ceiling; and a downrod having a ball mount at its upper end, the ball mount being supported in the hanger bracket.

6. A ceiling fan, the ceiling fan comprising in combination:

a downrod assembly having an upper end for mounting to a ceiling and a lower end having a flange;

a motor mounted to the lower end of the downrod assembly;

a set of fan blades joined to the motor;

a substantially flat metal top having a central opening through which the downrod assembly extends, the metal top being fastened to the flange of the downrod assembly;

an annular cylindrical glass sidewall having an upper circumferential edge which mates with a circumferential portion of the metal top;

a substantially flat glass bottom integrally joined to a lower edge of the sidewall, the glass bottom having a central opening through which the fan blades of the ceiling fan extend;

a plurality of vertically oriented holes spaced around a circumference of the metal top;

a plurality of vertically oriented holes spaced around a circumference of the glass bottom that register with the holes in the metal top;

a plurality of threaded rods extending vertically between the holes in the metal top and the holes in the glass bottom, each rod having an upper end and a lower end;

the upper ends of the rods extending above the metal top and the lower ends of the rods extending below the glass bottom and means at the upper and lower end of the rod for securing the integrally joined sidewall and bottom to the metal top wherein a housing is formed around the motor; and light means located within the housing for illuminating the inside of the housing and for projecting light to an exterior of the housing.

7. The ceiling fan according to claim 6 wherein the metal top further comprises a lip around the circumference of the metal top, the lip fitting over the upper circumferential edge of the glass sidewall.

8. The ceiling fan according to claim 6 wherein the light means comprises a light socket supported by the metal top.

9. The ceiling fan according to claim 6 wherein the central opening in the glass bottom is sized so as to leave a clearance between the opening in the glass bottom and the motor wherein the motor does not contact the housing.

10. The ceiling fan according to claim 6 further comprising a light fixture mounted to the motor and below the housing.

11. A ceiling fan, the ceiling fan comprising in combination:

a downrod assembly having an upper end for mounting to a ceiling and a lower end having a flange;

a motor mounted to the lower end of the downrod assembly;

a set of fan blades joined to the motor;

a substantially flat metal top having a central opening through which the downrod assembly extends, the metal top being fastened to the flange of the downrod assembly;

an annular cylindrical glass sidewall having an upper circumferential edge which mates with a circumferential portion of the metal top;

a substantially flat glass bottom integrally joined to a lower edge of the sidewall, the glass bottom having a central opening through which the fan blades of the ceiling fan extend;

a plurality of vertically oriented holes spaced around a circumference of the metal top;

a plurality of vertically oriented holes spaced around a circumference of the glass bottom that register with the holes in the metal top;

a plurality of threaded rods extending vertically between the holes in the metal top and the holes in the glass bottom, each rod having an upper end and a lower end;

the upper ends of the rods extending above the metal top and the lower ends of the rods extending below the glass bottom and means at the upper and lower ends of the rods for securing the integrally joined sidewall and bottom to the metal top wherein a housing is formed around the motor;

the central opening in the glass bottom being sized so as to leave a clearance between the central opening in the glass bottom and the motor wherein the motor does not contact the housing; and light means located within the housing for illuminating the inside of the housing and for projecting light to an exterior of the housing.

12. The ceiling fan according to claim 11 further comprising a light fixture mounted to the motor and below the housing.

13. The ceiling fan according to claim 11 wherein the metal top further comprises a lip around the circumference of the metal top, the lip fitting over the upper circumferential edge of the glass sidewall.

14. The ceiling fan according to claim 11 wherein the light means comprises a light socket supported by the metal top.

* * * * *